US008733562B2

(12) United States Patent
Kao

(10) Patent No.: US 8,733,562 B2
(45) **Date of Patent: *May 27, 2014**

(54) SLEEVE BRACKET ASSEMBLY

(71) Applicant: Jui-Chien Kao, Taichung (TW)

(72) Inventor: Jui-Chien Kao, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/939,469

(22) Filed: Jul. 11, 2013

(65) Prior Publication Data

US 2013/0306581 A1 Nov. 21, 2013

Related U.S. Application Data

(63) Continuation-in-part of application No. 13/205,182, filed on Aug. 8, 2011, now abandoned.

(51) Int. Cl.
*A47F 7/00* (2006.01)
*B65D 85/28* (2006.01)
*A47F 5/08* (2006.01)

(52) U.S. Cl.
USPC ..... 211/70.6; 206/378; 211/94.01

(58) Field of Classification Search
CPC ..... A47F 5/0846; B25H 3/06
USPC ..... 211/69.1, 70.6, 94.01; 206/378, 493, 206/349
See application file for complete search history.

(56) References Cited

U.S. PATENT DOCUMENTS 2,867,857 A * 1/1959 McCarthy ..... 52/584.1
3,324,617 A 6/1967 Knight et al.
4,450,970 A * 5/1984 Shepherd ..... 211/189
4,607,753 A 8/1986 Radek
4,621,738 A * 11/1986 DeLucchi ..... 211/70.6
4,674,240 A * 6/1987 Strausheim ..... 52/36.4
4,809,479 A * 3/1989 Tierno et al. ..... 52/588.1
4,826,021 A 5/1989 Burrell
4,927,020 A 5/1990 Randy
5,217,115 A 6/1993 Purkapile
5,228,570 A * 7/1993 Robinson ..... 206/378
5,284,245 A 2/1994 Slivon et al.
5,372,344 A * 12/1994 Syvuk ..... 248/225.11
5,398,823 A 3/1995 Anders
5,725,107 A * 3/1998 Dembicks ..... 211/70.6
D393,909 S * 4/1998 Current ..... D25/123
5,775,521 A * 7/1998 Tisbo ..... 211/94.01
5,791,093 A 8/1998 Diamond
5,819,490 A * 10/1998 Current ..... 52/588.1
5,862,913 A * 1/1999 Chou ..... 206/378
5,899,344 A * 5/1999 Current et al. ..... 211/94.01
5,983,574 A * 11/1999 Holztrager ..... 52/36.5
6,032,797 A * 3/2000 Kao ..... 206/378
6,070,745 A * 6/2000 Dembicks ..... 211/70.6
6,131,866 A * 10/2000 Kesinger ..... 248/225.11
6,168,018 B1 * 1/2001 Ramsey et al. ..... 206/378
6,325,223 B1 * 12/2001 Hannen ..... 211/87.01
6,386,363 B1 * 5/2002 Huang ..... 206/378

(Continued)

*Primary Examiner* — Darnell Jayne
*Assistant Examiner* — Kimberley S Wright
(74) *Attorney, Agent, or Firm* — patenttm.us

(57) ABSTRACT

A sleeve bracket assembly has a frame, multiple first sleeve mounts and multiple second sleeve mounts. The frame has a first bracket and a second bracket connected with the first bracket. The first sleeve mounts are mounted on the first bracket and the second sleeve mounts are mounted on the second bracket. Accordingly, the sleeve bracket assembly can display different sets of sleeves at the same time and no additional sleeve bracket assembly is required. A user does not have to purchase a new sleeve bracket assembly and carrying one sleeve bracket assembly is convenient.

3 Claims, 16 Drawing Sheets

(56) References Cited

U.S. PATENT DOCUMENTS

| | | | | |
|---|---|---|---|---|
| 6,450,338 | B1 * | 9/2002 | Chen | 206/378 |
| 6,488,151 | B2 * | 12/2002 | Ramsey et al. | 206/378 |
| 6,494,329 | B1 * | 12/2002 | Dembicks | 211/70.6 |
| 6,626,402 | B1 * | 9/2003 | Kaminstein | 248/110 |
| 6,991,105 | B2 * | 1/2006 | Winnard | 206/378 |
| D533,283 | S * | 12/2006 | Holztrager | D25/123 |
| 7,232,121 | B2 * | 6/2007 | Haruna | 269/309 |
| 7,571,571 | B1 | 8/2009 | Mershon | |
| 7,669,723 | B2 * | 3/2010 | Kao | 211/70.6 |
| 7,905,354 | B1 * | 3/2011 | Geibel | 206/378 |
| 8,152,003 | B1 | 4/2012 | Kao | |
| 8,302,785 | B2 * | 11/2012 | Kao | 211/70.6 |
| 8,302,786 | B2 * | 11/2012 | Kao | 211/70.6 |
| 8,381,905 | B1 * | 2/2013 | Kao | 206/378 |
| 8,403,155 | B1 * | 3/2013 | Kao | 211/70.6 |
| 8,479,929 | B1 * | 7/2013 | Kao | 211/70.6 |
| 8,517,188 | B2 * | 8/2013 | Kao | 211/70.6 |
| 2003/0150824 | A1 * | 8/2003 | McNeely | 211/70.6 |
| 2003/0233926 | A1 * | 12/2003 | Makropoulos | 83/829 |
| 2006/0091094 | A1 * | 5/2006 | Schuberth | 211/94.01 |
| 2007/0056921 | A1 * | 3/2007 | Lo | 211/94.01 |
| 2007/0210021 | A1 * | 9/2007 | Whitehead et al. | 211/70.6 |
| 2007/0221594 | A1 * | 9/2007 | Pierro | 211/94.01 |
| 2009/0090644 | A1 * | 4/2009 | Kao | 206/373 |
| 2009/0134290 | A1 * | 5/2009 | Begic et al. | 248/222.13 |
| 2010/0065520 | A1 * | 3/2010 | Hsieh | 211/70.6 |
| 2011/0048989 | A1 * | 3/2011 | Winnard | 206/378 |
| 2011/0089126 | A1 * | 4/2011 | Hsieh | 211/70.6 |
| 2012/0096698 | A1 * | 4/2012 | Ernst | 29/428 |
| 2012/0138553 | A1 * | 6/2012 | Kao | 211/70.6 |
| 2013/0062480 | A1 * | 3/2013 | Kao | 248/201 |
| 2013/0068643 | A1 * | 3/2013 | Hsieh | 206/349 |
| 2013/0153521 | A1 * | 6/2013 | Kao | 211/70.6 |
| 2013/0186243 | A1 * | 7/2013 | Harper et al. | 81/180.1 |

* cited by examiner

SLEEVE BRACKET ASSEMBLY

The present invention is a continuation-in-part application of the application Ser. No. 13/205,182, filed on Aug. 8, 2011.

BACKGROUND OF THE INVENTION

1. Field of the Invention

The present invention relates to a sleeve bracket assembly, and more particularly to a sleeve bracket assembly displaying different sets of sleeves at the same time and capable of being mounted on different walls.

2. Description of Related Art

A conventional sleeve bracket assembly can merely display one set of sleeves that have slightly different sizes. An additional sleeve bracket assembly is required to receive another set of sleeves. For example, three sleeve bracket assemblies are needed to receive whole sets of sleeves that comprise complete sizes.

However, purchasing new sleeve bracket assemblies increases a purchasing cost and carrying multiple sleeve bracket assemblies is inconvenient.

With reference to U.S. Pat. No. 5,791,093 ("DIAMOND"), DIAMOND may display different sets of sleeves at the same time. DIAMOND has a plurality of horizontally-oriented, vertically arrayed extruded slatwall members. However, multiple sleeves are placed latitudinally when the sleeves are hung on the vertical slatwall members. Size marks printed on the sleeves are hard to see for users, and this is inconvenient for users to quickly take a sleeve of desired size.

Moreover, DIAMOND is affixed to a wall by screws via round mounting holes. The screws cannot be moved along the mounting holes such that DIAMOND can only be affixed on a specific wall, and this is not versatile in use. To overcome the shortcomings, the present invention tends to provide a sleeve bracket assembly to mitigate the aforementioned problems.

SUMMARY OF THE INVENTION

The main objective of the invention is to provide a sleeve bracket assembly that can display different sets of sleeves at the same time and capable of being mounted on different walls.

A sleeve bracket assembly has a frame, multiple first sleeve mounts and multiple second sleeve mounts. The frame has a first bracket and a second bracket connected with the first bracket. The first sleeve mounts are mounted on the first bracket and the second sleeve mounts are mounted on the second bracket. Accordingly, the sleeve bracket assembly can display different sets of sleeves at the same time and no additional sleeve bracket assembly is required. A user does not have to purchase a new sleeve bracket assembly and carrying one sleeve bracket assembly is convenient.

Other objects, advantages and novel features of the invention will become more apparent from the following detailed description when taken in conjunction with the accompanying drawings.

DETAILED DESCRIPTION OF PREFERRED EMBODIMENT

Figure 1:
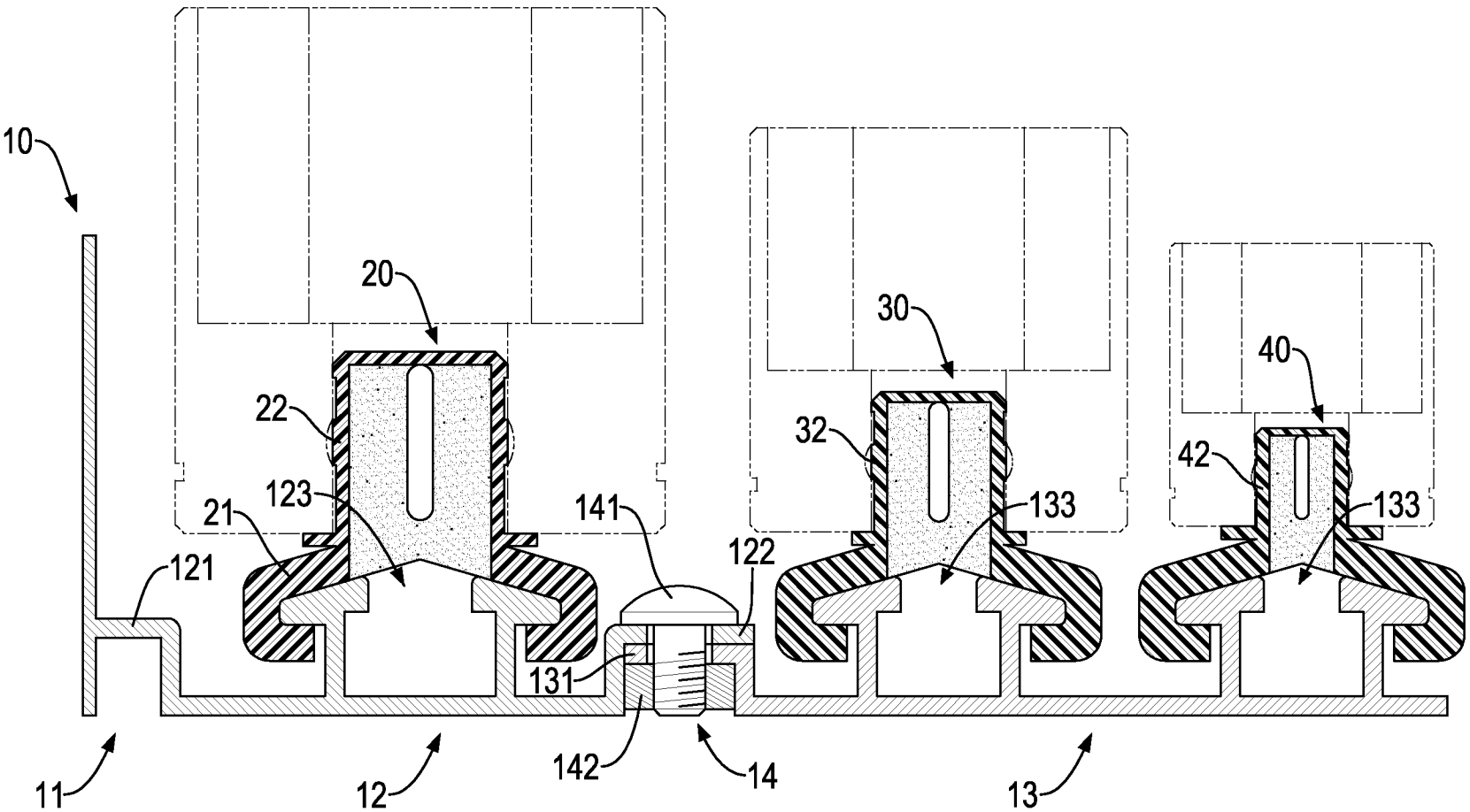
FIG. 1 is a side view in partial section of a first embodiment of a sleeve bracket assembly in accordance with the present invention.
Figure 2:
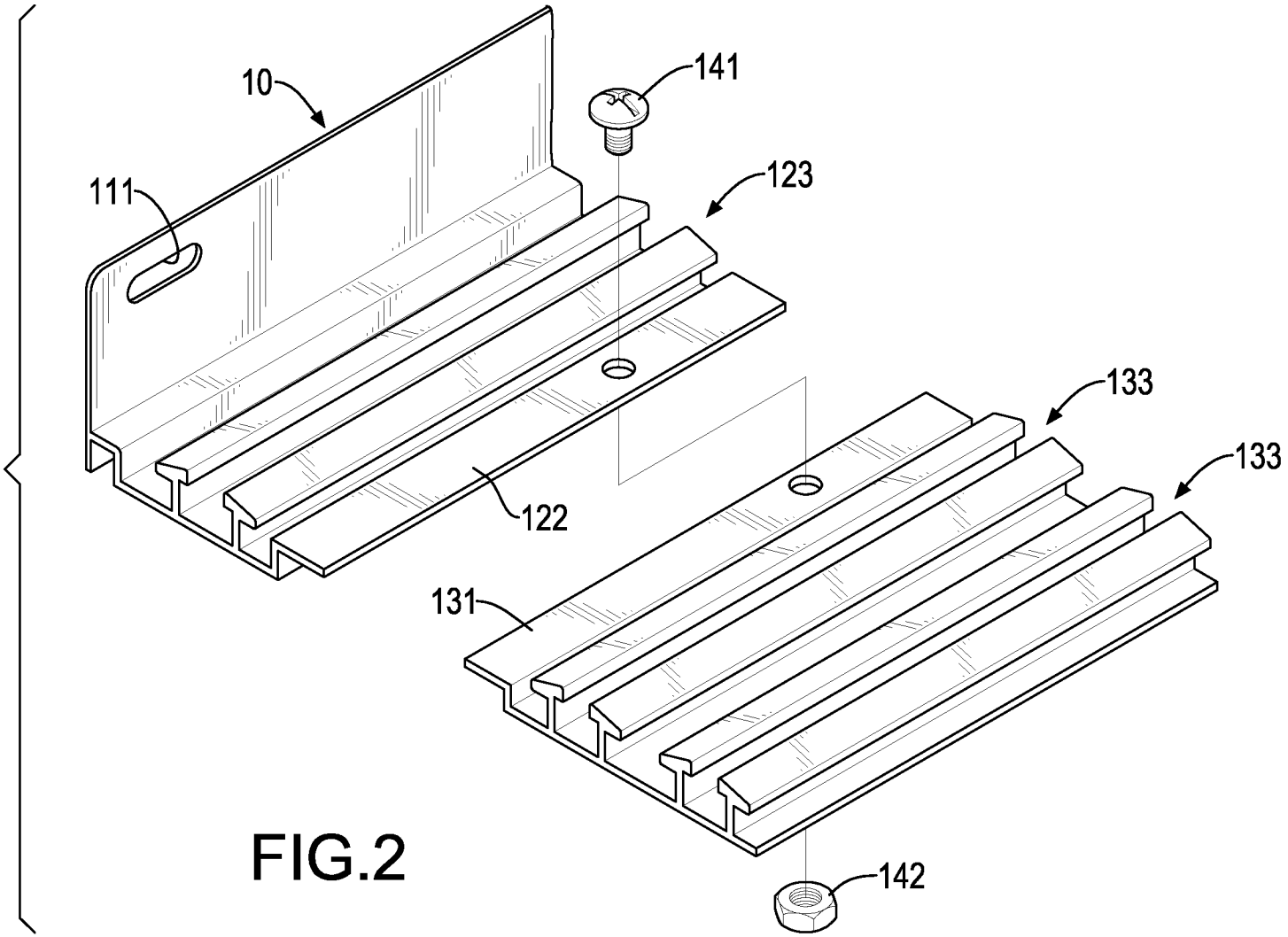
FIG. 2 is a partially exploded perspective view of the frame of the sleeve bracket assembly in FIG. 1.
Figure 3:
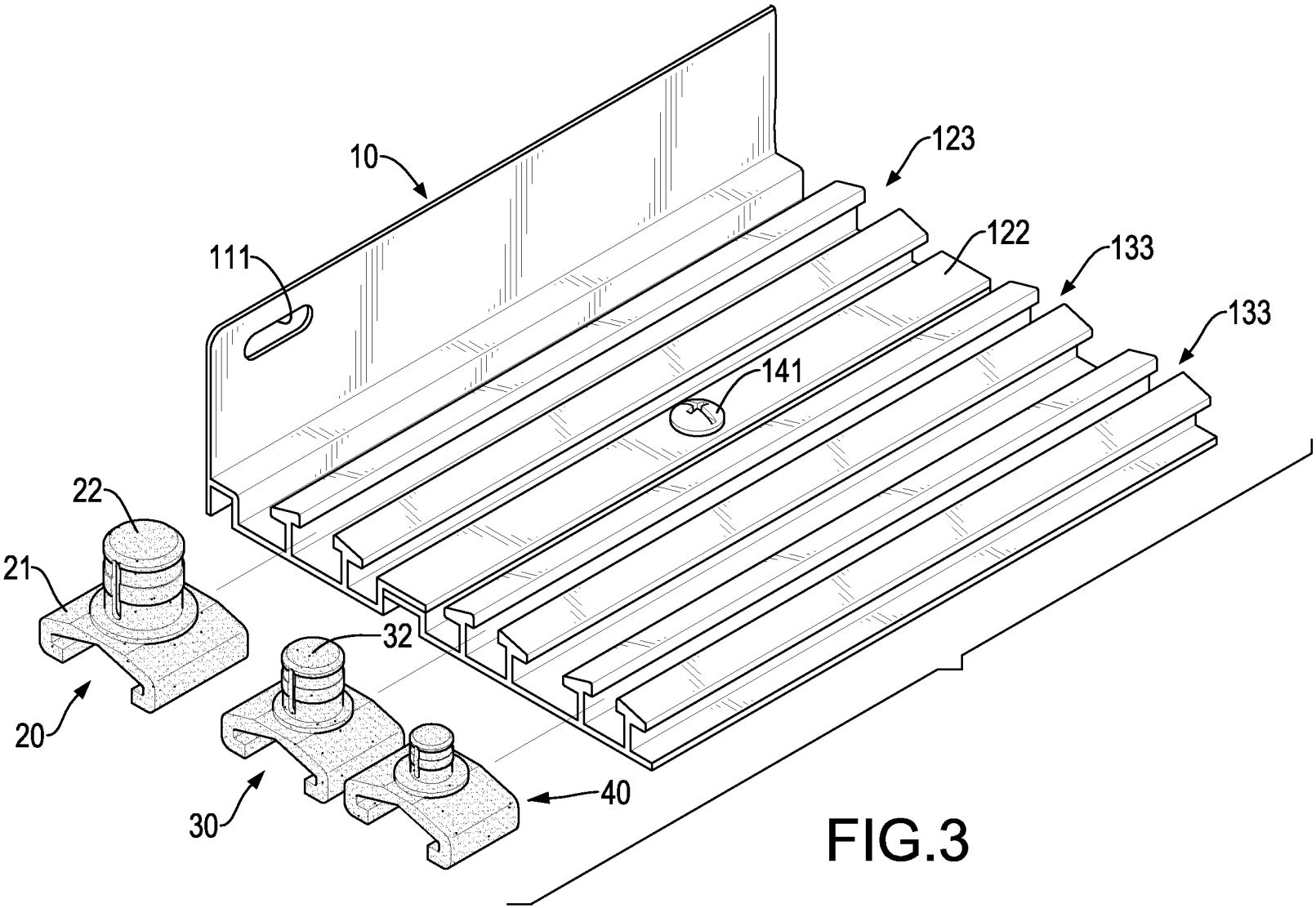
FIG. 3 is a partially exploded perspective view of the sleeve bracket assembly in FIG. 1.
Figure 4:
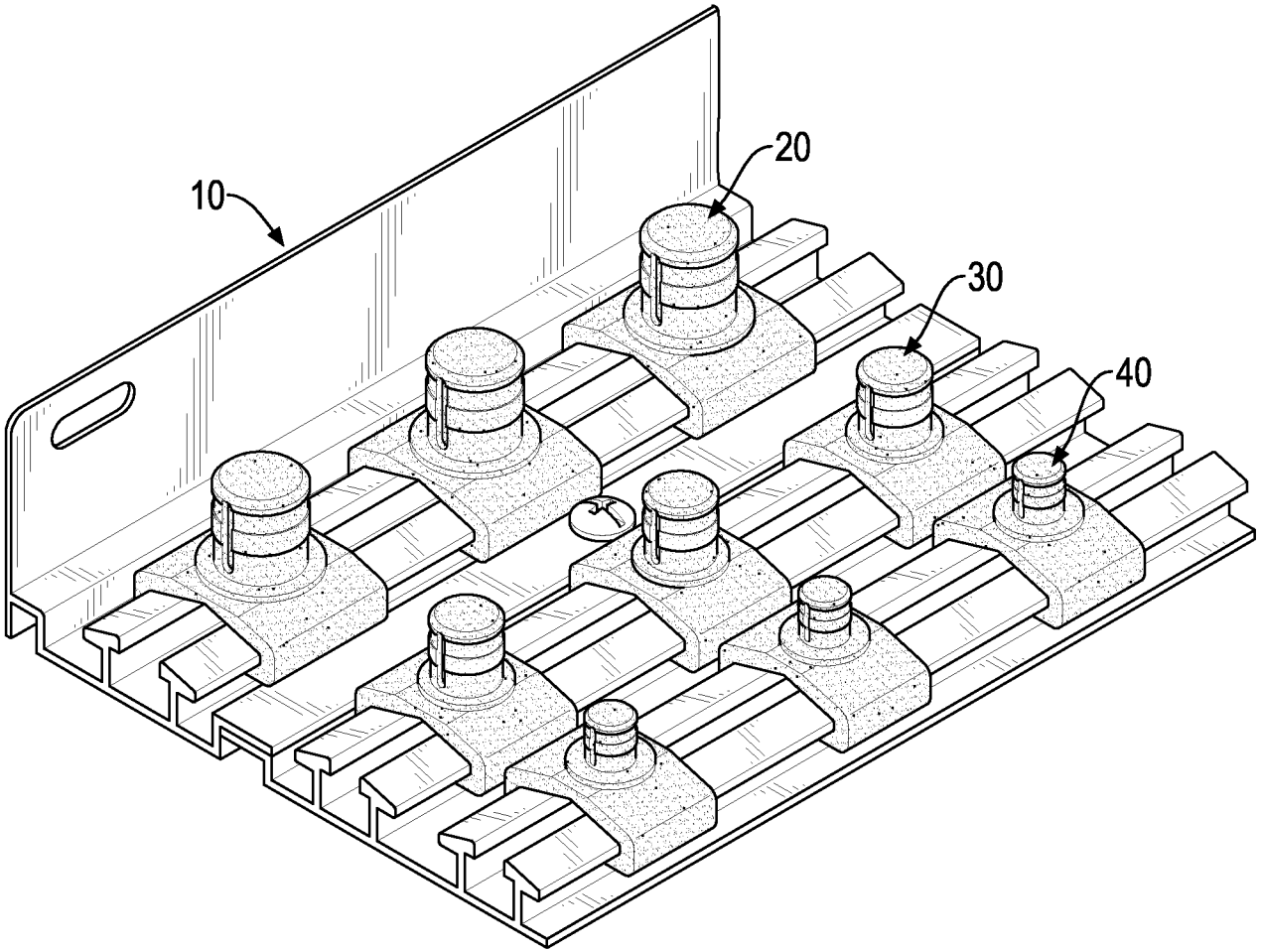
FIG. 4 is a partial perspective view of the sleeve bracket assembly in FIG. 1.
Figure 5:
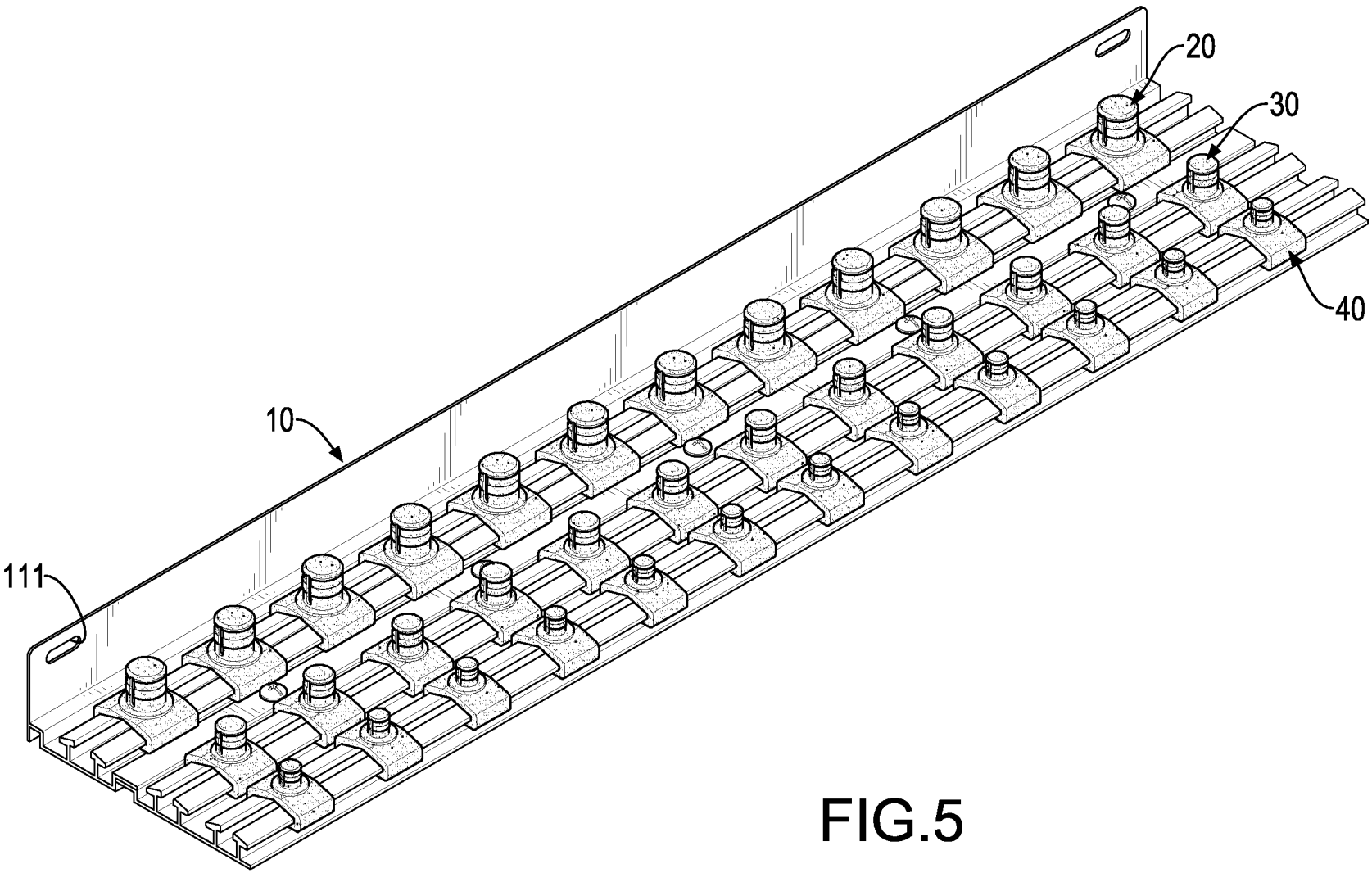
FIG. 5 is a perspective view of the sleeve bracket assembly in FIG. 1.
Figure 6:
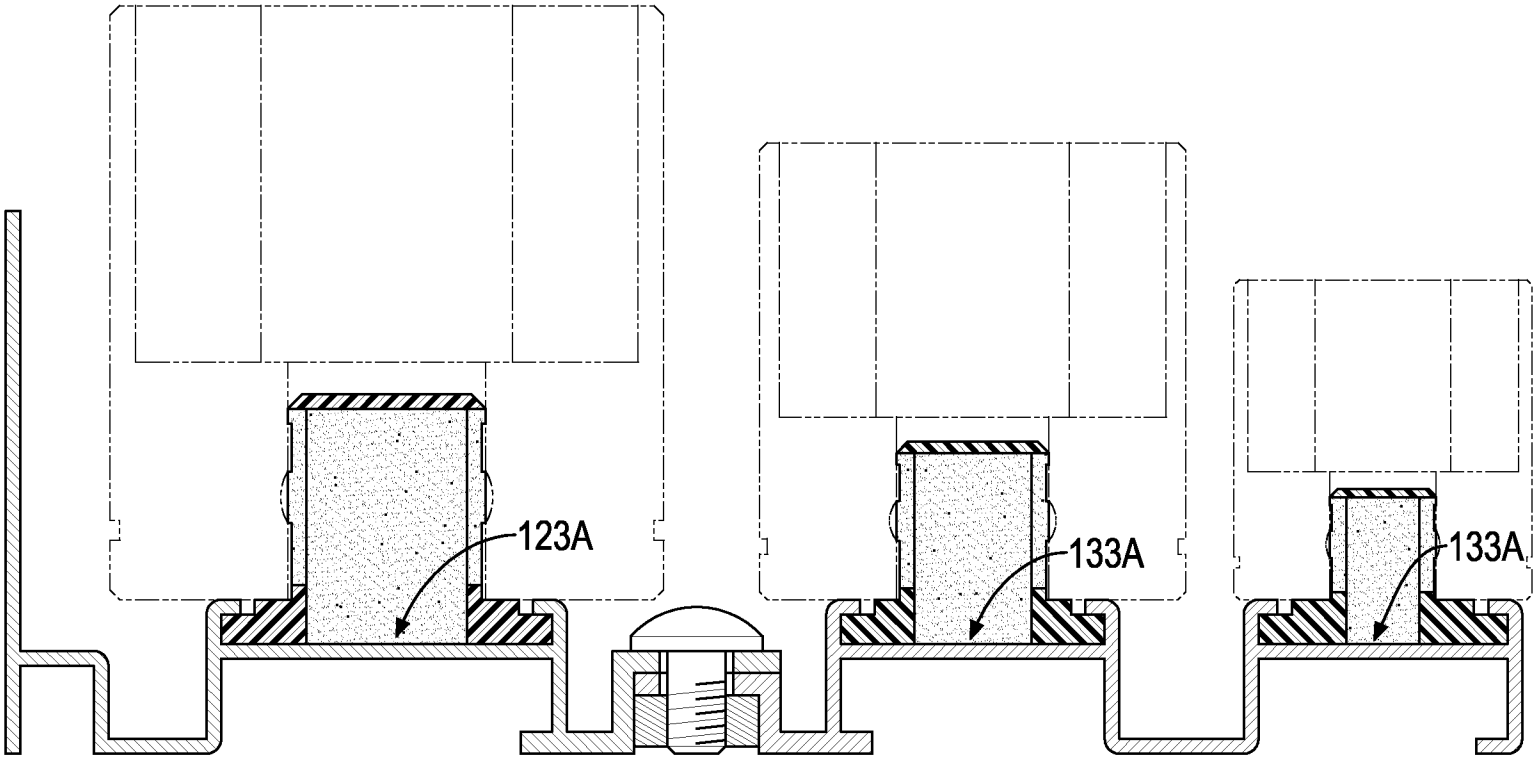
FIG. 6 is a side view in partial section of a second embodiment of a sleeve bracket assembly in accordance with the present invention.
Figure 7:
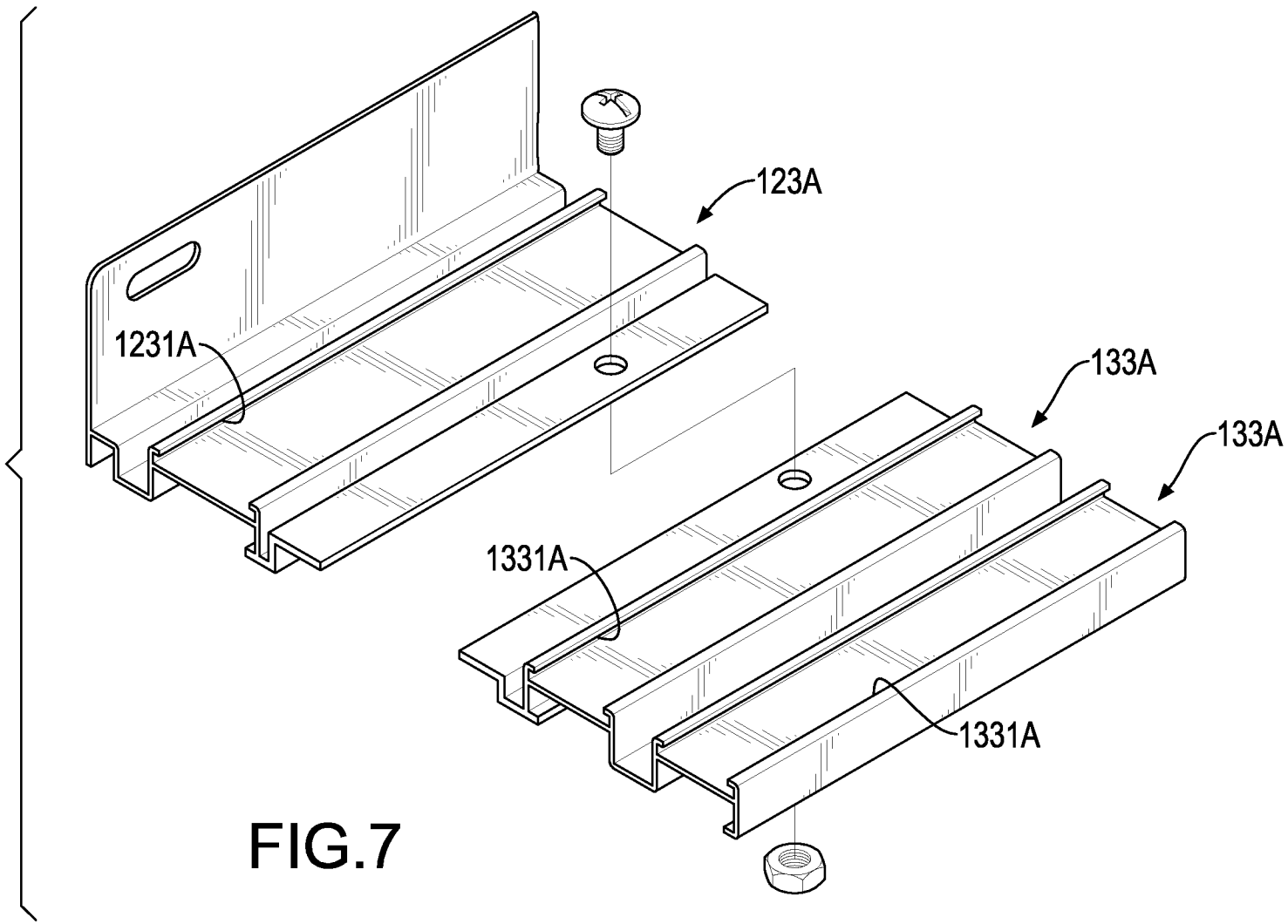
FIG. 7 is a partially exploded perspective view of the frame of the sleeve bracket assembly in FIG. 6.
Figure 8:
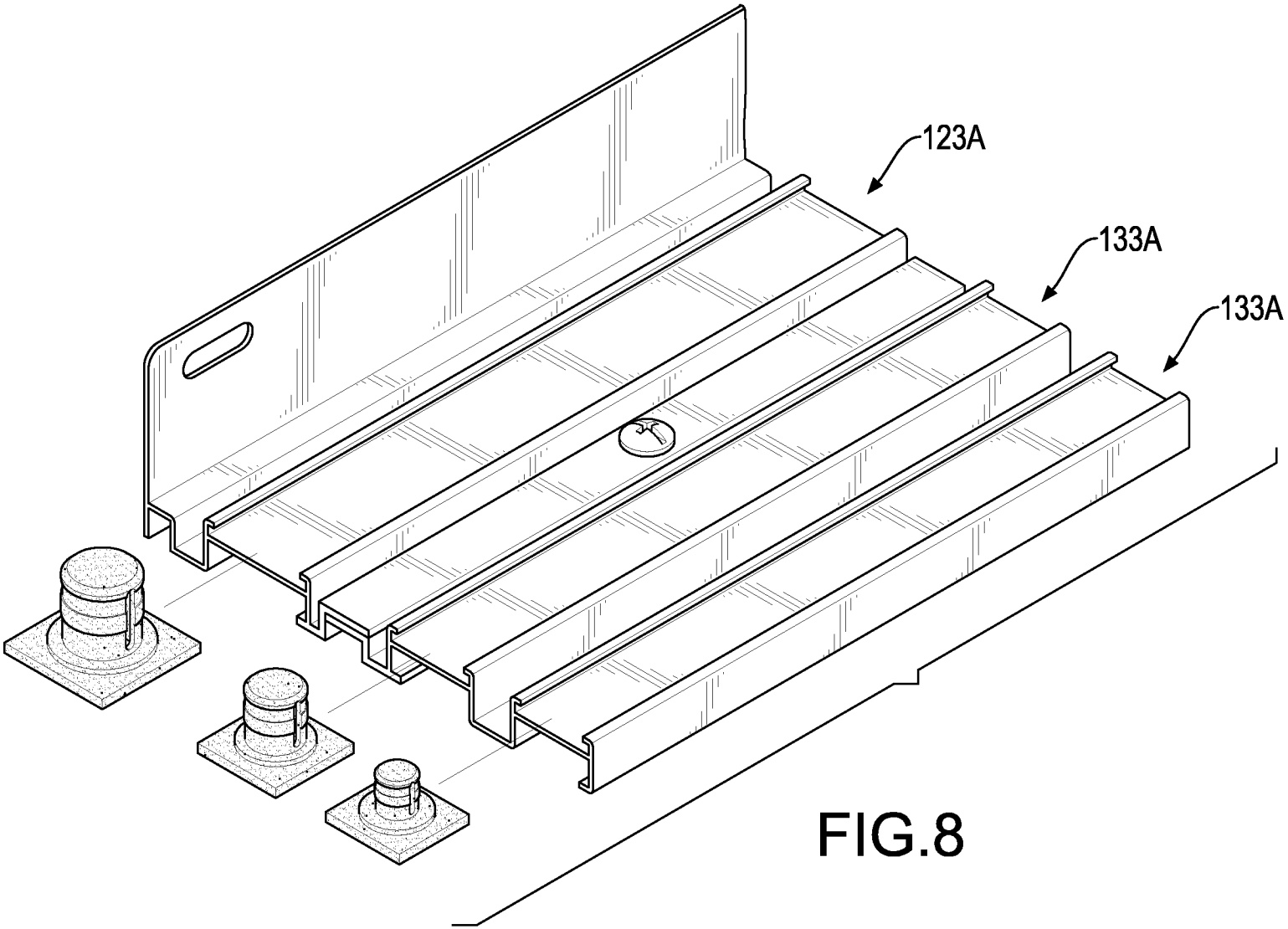
FIG. 8 is a partially exploded perspective view of the sleeve bracket assembly in FIG. 6.
Figure 9:
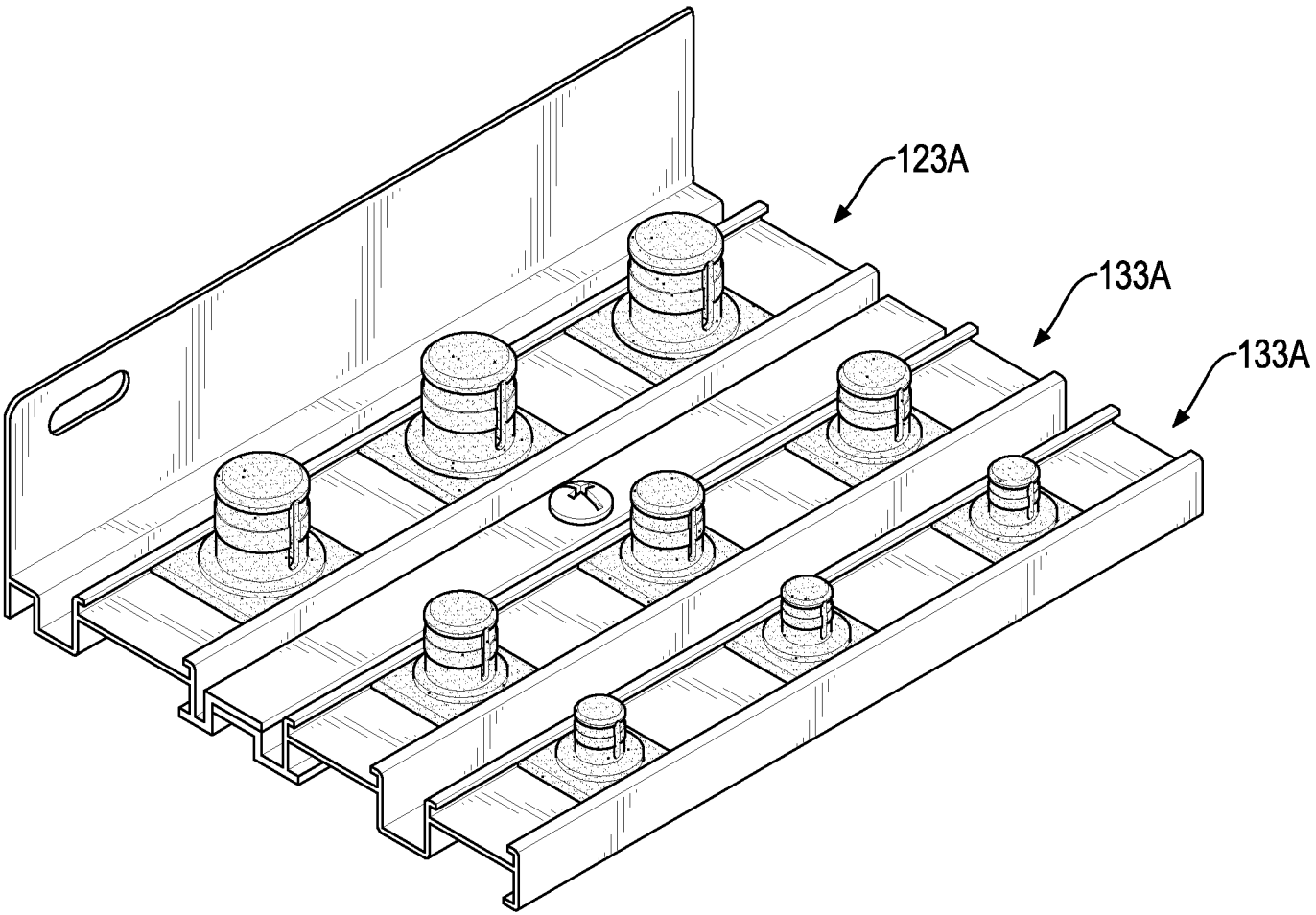
FIG. 9 is a partial perspective view of the sleeve bracket assembly in FIG. 6.
Figure 10:
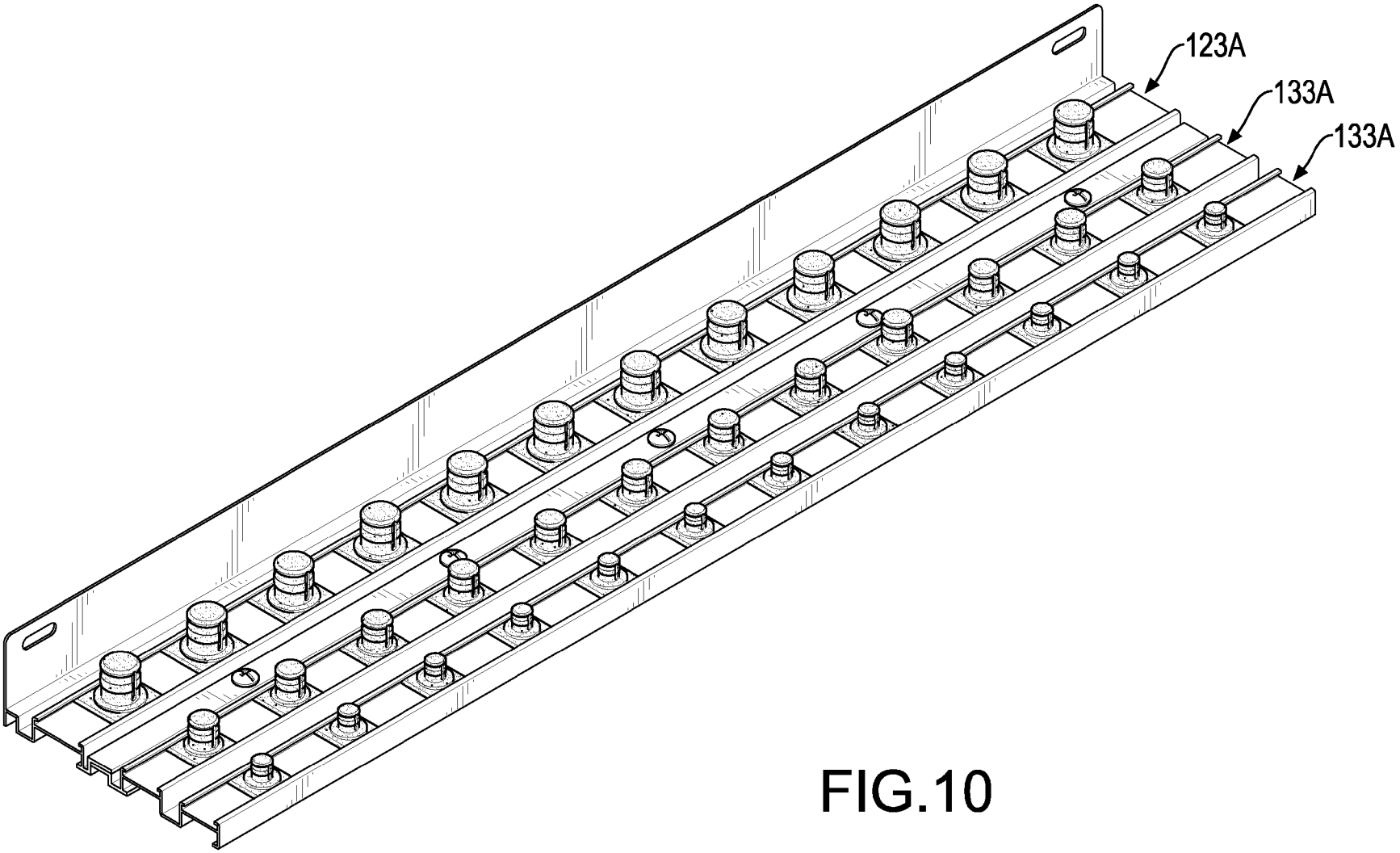
FIG. 10 is a perspective view of the sleeve bracket assembly in FIG. 6.

With reference to FIGS. 1 to 5, a first embodiment of a sleeve bracket assembly in accordance with the present invention comprises a frame 10, multiple first sleeve mounts 20, multiple second sleeve mounts 30 and multiple third sleeve mounts 40.

The frame 10 has a back plate 11, a first bracket 12, a second bracket 13 and multiple securing members 14. The back plate 11 is elongated and has a top, a bottom, two opposite ends, a length, a side surface and two elongated mounting holes 111. The bottom of the back plate 11 is opposite to the top of the back plate 11. The mounting holes 111 are formed through near the top and respectively near the opposite ends of the back plate 11. The two mounting holes 111 are elongated, are located at a latitudinal line and extend toward the opposite ends of the back plate 11.

The first bracket 12 is elongated and is formed integrally on the side surface of the back plate 11 and has a top surface, a bottom surface, a length, a combining section 121, a connecting side section 122 and a sleeve track 123. The bottom surface of the first bracket 12 is opposite to the top surface of the first bracket 12. The length of the first bracket 12 is same as that of the back plate 11. The combining section 121 is L-shaped and is connected securely on the side surface of the back plate 11. The connecting side section 122 is opposite to the combining section 121. The sleeve track 123 is linear, is formed on and protrudes from the top surface of the first bracket 12 and has two parallel rails and a length the same as that of the back plate 11.

The second bracket 13 is elongated, is connected securely with the connecting side section 122 of the first bracket 12 and has a top surface, a bottom surface, a length, an attaching side section 131 and two linear sleeve tracks 133.

The bottom surface of the second bracket 13 is opposite to the top surface of the second bracket 13. The bottoms surfaces of the first bracket 12 and the second bracket 13 are located at the same latitudinal plane.

The attaching side section 131 abuts the connecting side section 122 of the first bracket 12. Preferably, the connecting side section 122 and the attaching side section 131 are L-shaped.

Each sleeve track 133 is formed on and protrudes from the top surface of the second bracket 13 and has two parallel rails and a length the same as that of the back plate 11. The sleeve tracks 123,133 are parallel to one another.

Each securing member 14 is mounted through the connecting side section 122 and the attaching side section 131 and has a bolt 141 and a nut 142 connected with the bolt 141.

With reference to FIGS. 1 to 5, the first sleeve mounts 20 are detachably connected with the sleeve track 123 of the first bracket 12. Each first sleeve mount 20 has a base 21 and a positioning button 22. Each base 21 has a top surface and is slidably connected with the sleeve track 123 of the first bracket 12. Preferably, each base 21 wraps tops of the rails of the sleeve track 123 of the first bracket 12. Each positioning button 22 is formed on and protrudes from the top surface of the base 21.

The second sleeve mounts 30 and the third sleeve mounts 40 are substantially the same as the first sleeve mounts 20. The second sleeve mounts 30 are all detachably and slidably connected with one of the sleeve tracks 133 of the second bracket 13. The third sleeve mounts 40 are all detachably and slidably connected with the other sleeve track 133 of the second bracket 13.

Preferably, a cross section of the positioning button 22 of each first sleeve mount 20 is larger than that of each second sleeve mount 30. A cross section of the positioning button 32 of each second sleeve mount 30 is larger than a cross section of the positioning button 42 of each third sleeve mount 40. Accordingly, heavier sleeves can be placed closer to the back plate 11 to prevent the second bracket 13 from being broken.

With reference to FIGS. 6 to 10, a second embodiment of the sleeve bracket assembly is substantially the same as the first embodiment except that structures of the sleeve track 123A,133A are different. Each sleeve track 123A,133A has two parallel bars and a groove 1231A,1331A formed between the bars.

Figure 11:
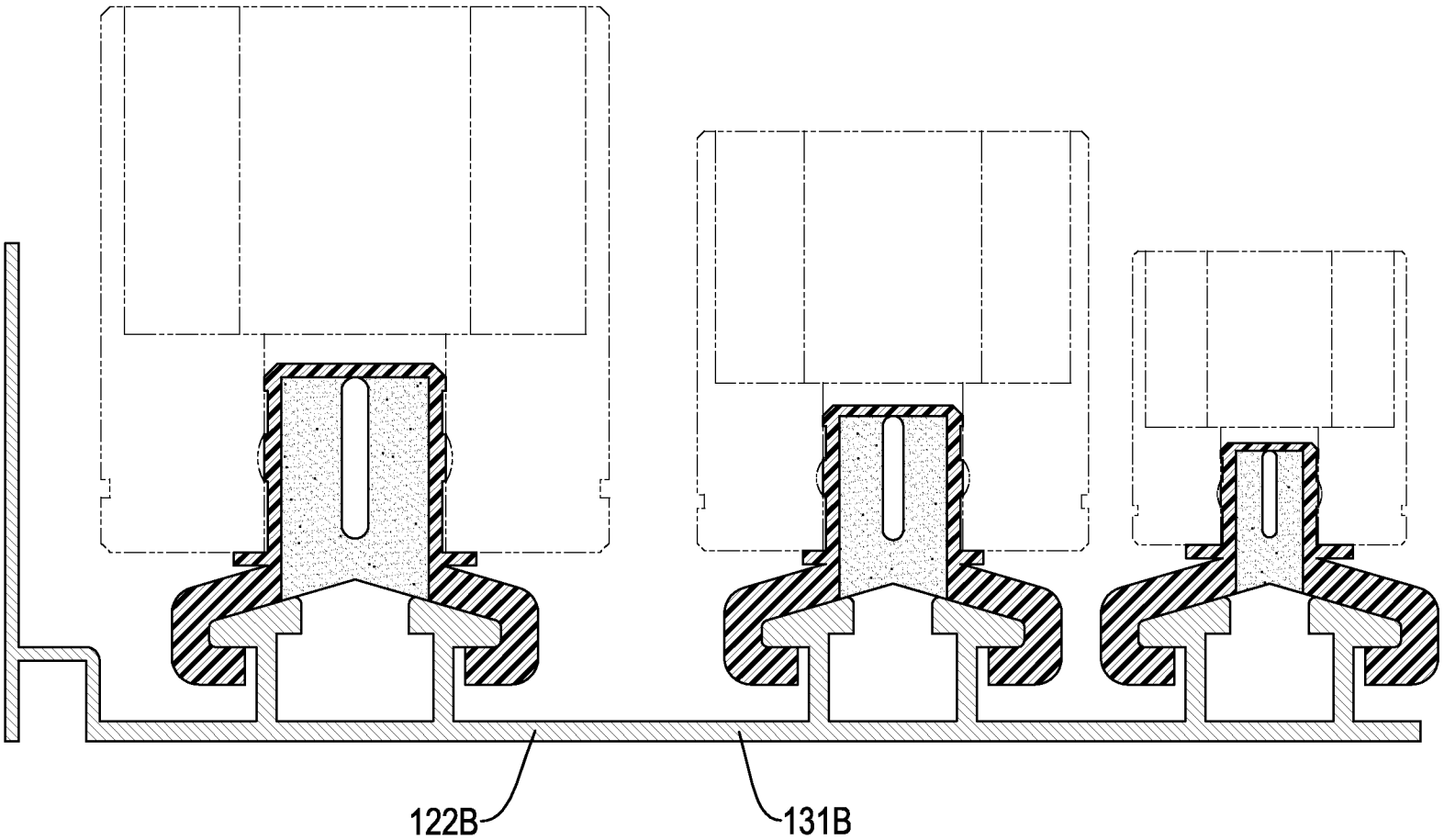
FIG. 11 is a side view in partial section of a third embodiment of a sleeve bracket assembly in accordance with the present invention.
Figure 12:
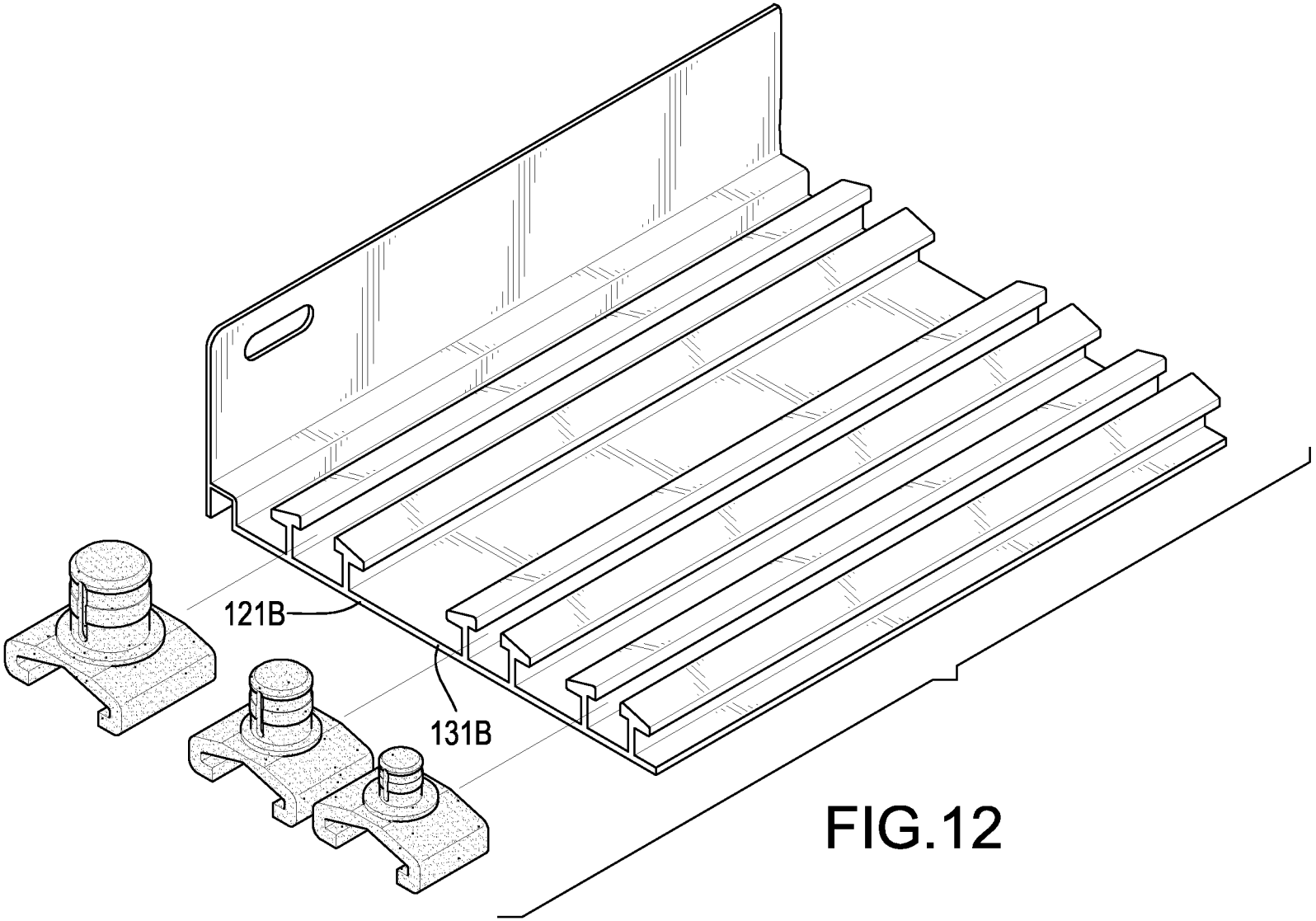
FIG. 12 is a partially exploded perspective view of the sleeve bracket assembly in FIG. 11.

With reference to FIGS. 11 and 12, a third embodiment of the sleeve bracket assembly is substantially the same as the first embodiment except the following features.

The connecting side section 122B and the attaching side section 131B are integrally connected with each other to form a single flat plate.

Figure 13:
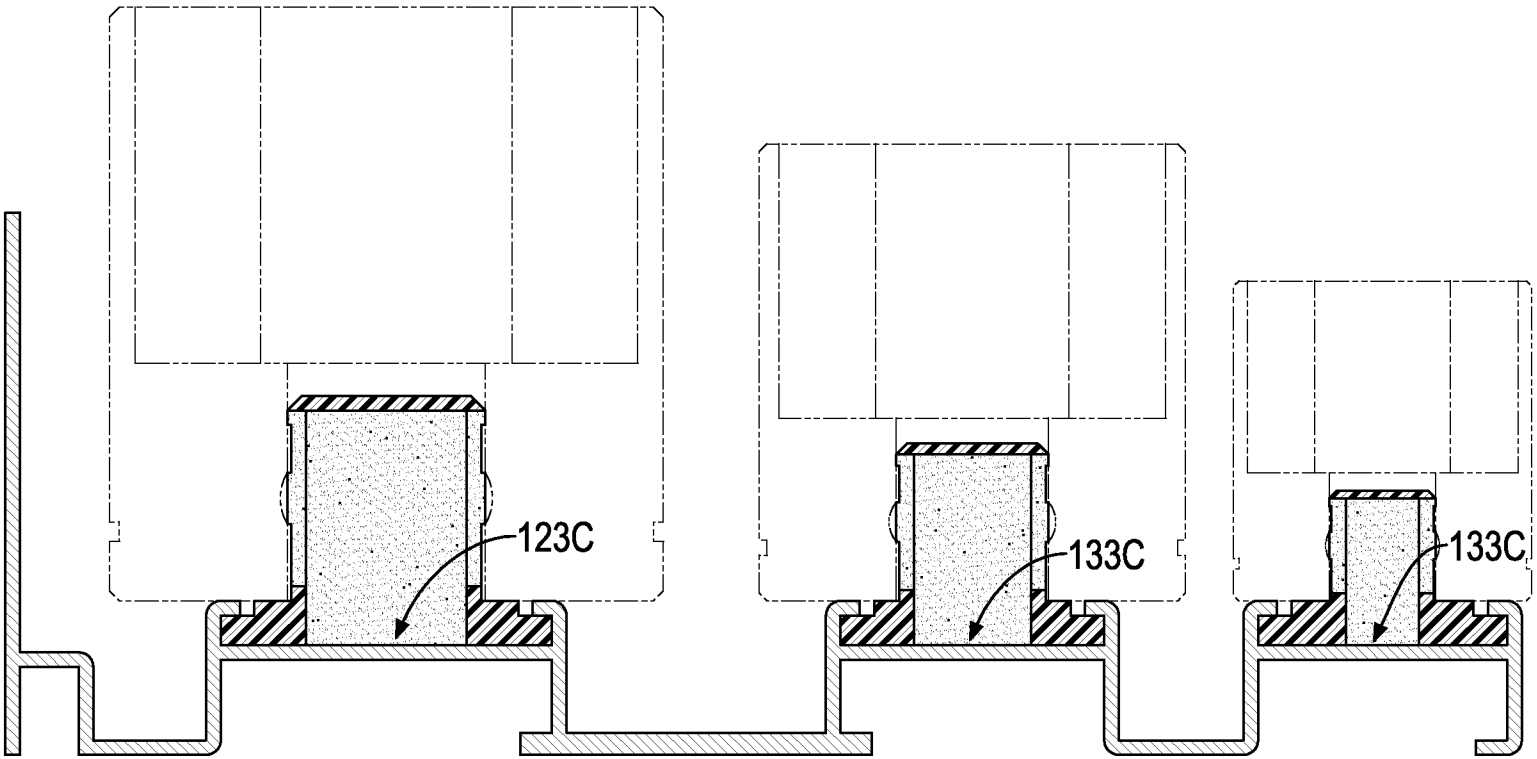
FIG. 13 is a side view in partial section of a fourth embodiment of a sleeve bracket assembly in accordance with the present invention.
Figure 14:
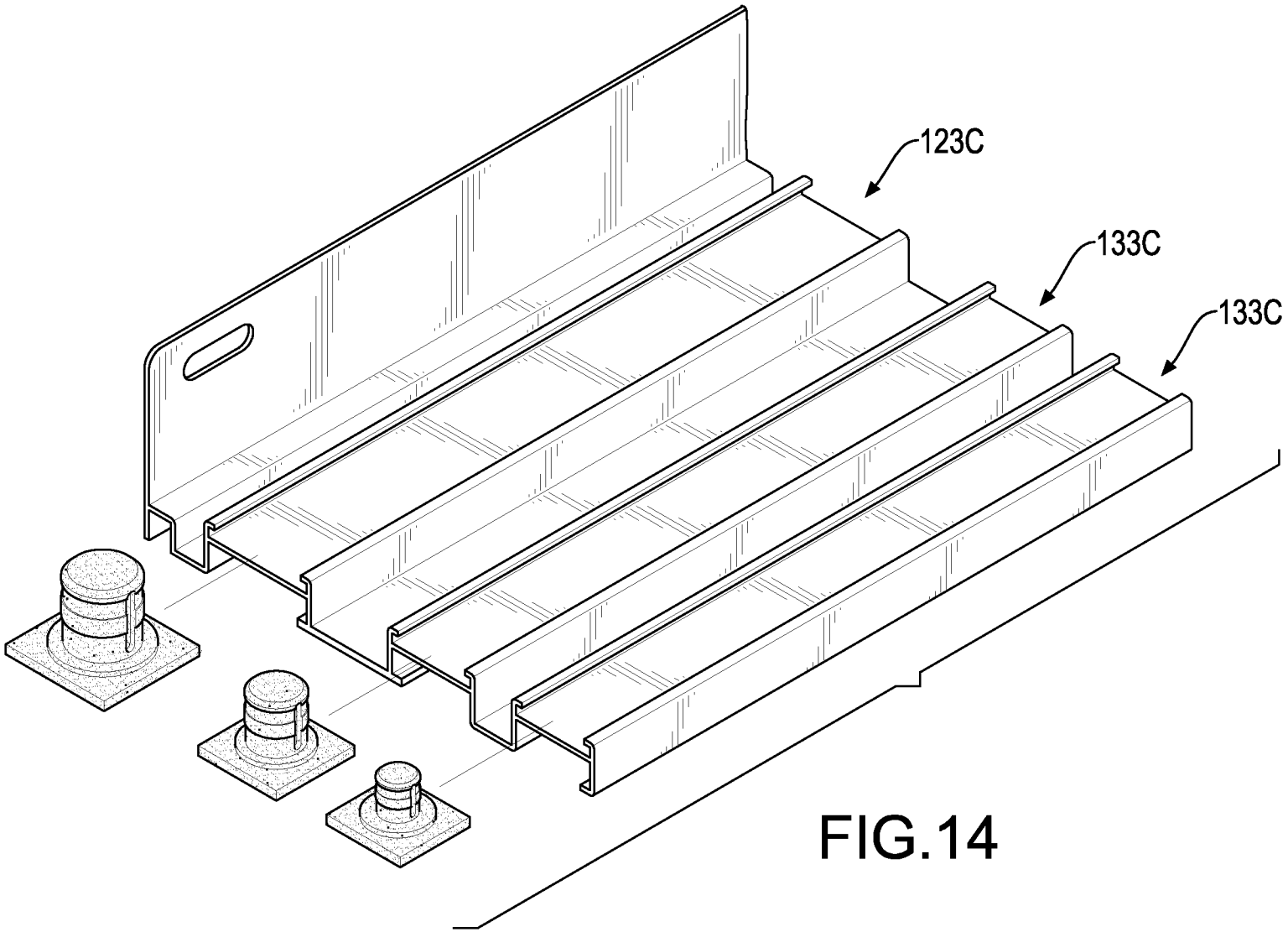
FIG. 14 is a partially exploded perspective view of the sleeve bracket assembly in FIG. 13.

With reference to FIGS. 13 and 14, a fourth embodiment of the sleeve bracket assembly is substantially the same as the third embodiment except that structures of the sleeve track 123C,133C are different.

Figure 15:
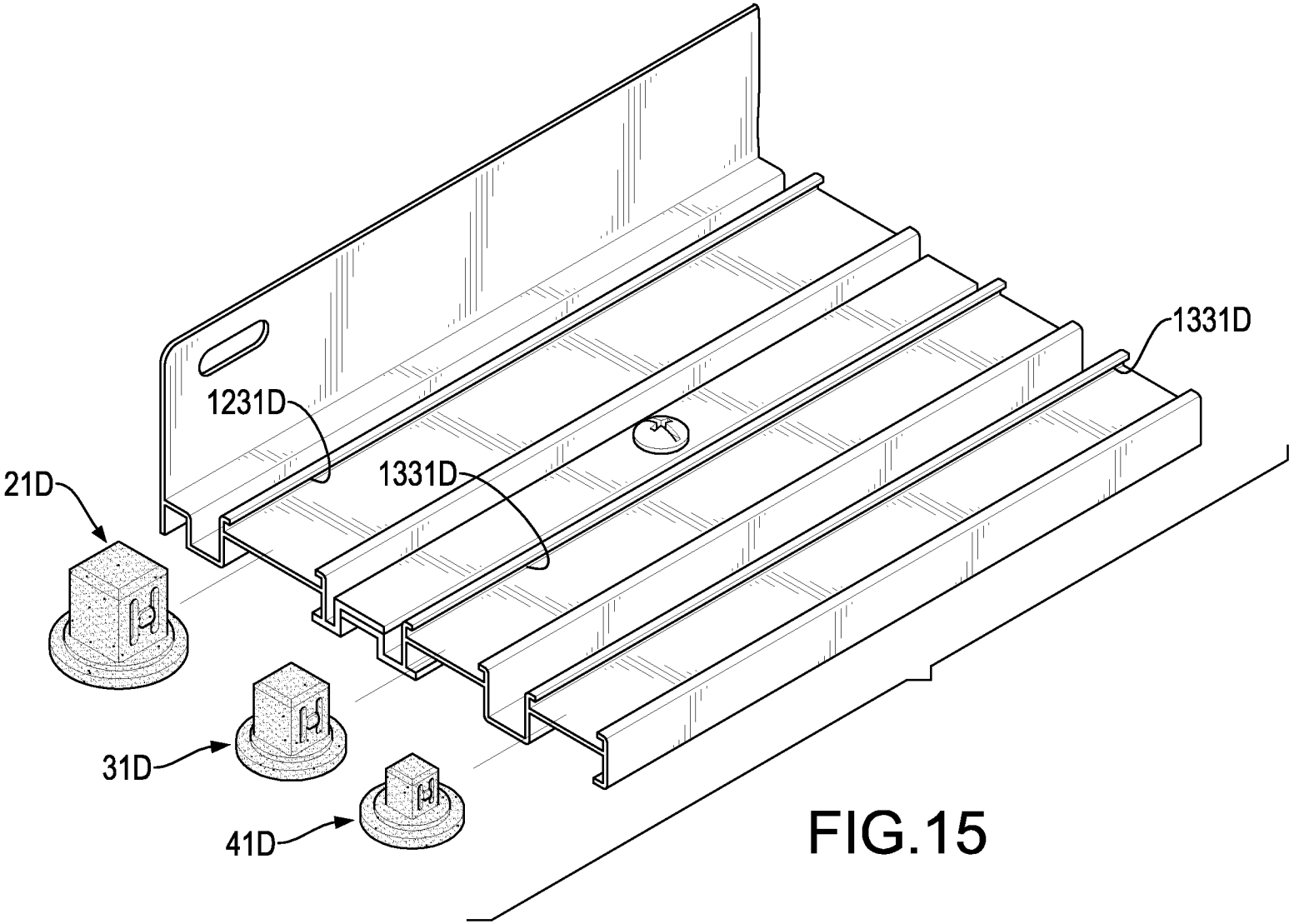
FIG. 15 is a partially exploded perspective view of a fifth embodiment of a sleeve bracket assembly in accordance with the present invention.
Figure 16:
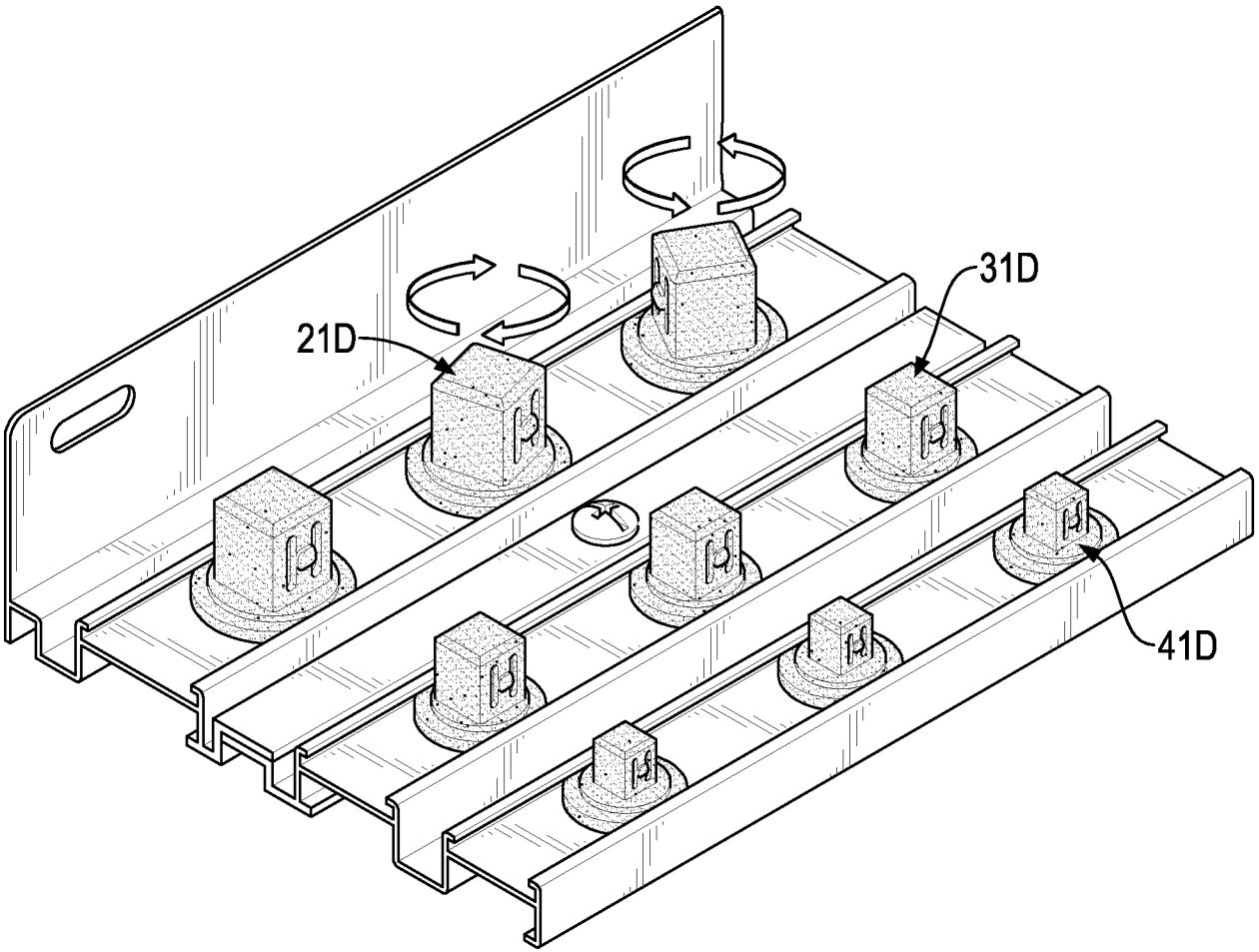
FIG. 16 is a perspective view of the sleeve bracket assembly in FIG. 15.

With reference to FIGS. 15 and 16, a fifth embodiment of the sleeve bracket assembly is substantially the same as the second embodiment except that the bases 21D,31D,41D respectively have a round cross section and are slidably mounted in the grooves 1231D,1331D.

From the above description, it is noted that the present invention has the following advantages:

1. Cost Reduction:

The sleeve bracket assembly in accordance with the present invention can display different sets of sleeves at the same time and no additional sleeve bracket assembly is required. Accordingly, a user does not have to purchase a new sleeve bracket assembly and carrying one sleeve bracket assembly is convenient.

2. Excellent Versatility:

In the first and second embodiments, a user can choose whether the second bracket 13 is connected with the first bracket 12 by the securing members 14. Accordingly, a format of the sleeve bracket assembly can be changed to meet a user's need and this is versatile and convenient.

3. Latitudinal Arrangement of the Sleeves:

Because the bottoms surfaces of the first bracket 12 and the second bracket 13 are located at the same latitudinal plane, the first bracket 12 and the second bracket 13 are latitudinal arranged. Accordingly, the sleeves placed on the frame 10 are also latitudinal arranged such that each sleeve stands upright. Size marks printed on the sleeves are easy to see for users, and this is convenient for users to quickly take a sleeve of desired size.

The first bracket 12 and the second bracket 13 are latitudinal arranged, where the first bracket 12 is connected with the back plate 11 bears great weight and needs to be strengthened. With the L-shaped combing section 121 of the first bracket 11, the structural strength is excellent and the combining section 121 can bear great weight.

4. Adjustable Design:

With the elongated mounting holes 111, screws can be moved along the mounting holes 111. Accordingly, the screws can be adjusted and the back plate 11 can be mounted on and fit different walls.

What is claimed is:

1. A sleeve bracket assembly comprising:

a frame having an elongated back plate having a top;

a bottom opposite to the top of the back plate;

two opposite ends;

a length;

a side surface; and two elongated mounting holes formed through near the top and respectively near the opposite ends of the back plate, wherein the two mounting holes are located at a latitudinal line and extend toward the opposite ends of the back plate;

an elongated first bracket formed integrally on the side surface of the back plate and having a top surface;

a bottom surface opposite to the top surface of the first bracket;

a length same as that of the back plate;

an L-shaped combining section connected securely on the side surface of the back plate;

an L-shaped connecting side section opposite to the combining section;

a linear sleeve track formed on and protruding from the top surface of the first bracket and having a length the same as that of the back plate;

an elongated second bracket connected securely with the connecting side section of the first bracket and having a top surface;

a bottom surface opposite to the top surface of the second bracket, wherein the bottoms surfaces of the first bracket and the second bracket are located at the same latitudinal plane;

a length same as that of the back plate;

an L-shaped attaching side section abutting the connecting side section of the first bracket; and two linear sleeve tracks formed on and protruding from the top surface of the second bracket, parallel to each other and each one of the sleeve tracks having a length the same as that of the back plate and parallel to the sleeve track of the first bracket; and multiple securing members, each securing member mounted through the connecting side section and the attaching side section and having a bolt and a nut connected with the bolt and abutting against the connecting side section and the attaching side section;

multiple first sleeve mounts detachably connected with the sleeve track of the first bracket, each first sleeve mount having a base having a top surface and slidably connected with the sleeve track of the first bracket; and a positioning button formed on and protruding from the top surface of the base;

multiple second sleeve mounts detachably connected with one of the sleeve tracks of the second bracket, each second sleeve mount having a base having a top surface and slidably connected with the corresponding one of the sleeve tracks of the second bracket; and a positioning button formed on and protruding from the top surface of the base of the second sleeve mount; wherein a cross section of the positioning button of each first sleeve mount is larger than that of each second sleeve mount; and multiple third sleeve mounts detachably connected with the other sleeve track of the second bracket, each third sleeve mount having a base having a top surface and slidably connected with the corresponding one of the sleeve tracks of the second bracket; and a positioning button formed on and protruding from the top surface of the base of the third sleeve mount, wherein a cross section of the positioning button of each second sleeve mount is larger than that of each third sleeve mount.

2. The sleeve bracket assembly as claimed in claim 1, wherein each sleeve track has a top surface and a groove formed in the top surface of the sleeve track; and the bases respectively have a round cross section and are slidably mounted in the grooves.

3. A sleeve bracket assembly comprising:

a frame having an elongated back plate having a top;

a bottom opposite to the top of the back plate;

two opposite ends;

a length;

a side surface; and two elongated mounting holes formed through near the top and respectively near the opposite ends of the back plate, wherein the two mounting holes are located at a latitudinal line and extend toward the opposite ends of the back plate;

an elongated first bracket formed integrally on the side surface of the back plate and having a top surface;

a bottom surface opposite to the top surface of the first bracket;

a length same as that of the back plate;

an L-shaped combining section connected securely on the side surface of the back plate;

a flat connecting side section opposite to the combining section;

a linear sleeve track formed on and protruding from the top surface of the first bracket and having a length the same as that of the back plate;

a top surface; and a groove formed in the top surface of the sleeve track;

an elongated second bracket connected securely with the connecting side section of the first bracket and having a top surface;

a bottom surface opposite to the top surface of the second bracket, wherein the bottom- surfaces of the first bracket and the second bracket are located at the same latitudinal plane;

a length same as that of the back plate;

a flat attaching side section connected integrally with the connecting side section of the first bracket to form a single flat plate; and two linear sleeve tracks formed on and protruding from the top surface of the second bracket, parallel to each other and each one of the sleeve tracks having a length the same as that of the back plate and parallel to the sleeve track of the first bracket;

a top surface; and a groove formed in the top surface of the sleeve track of the second bracket;

multiple first sleeve mounts detachably connected with the sleeve track of the first bracket, each first sleeve mount having a base having a top surface and slidably connected with the sleeve track of the first bracket, wherein the bases of the first sleeve mounts respectively have a round cross section and are slidably mounted in the groove of the first bracket; and a positioning button formed on and protruding from the top surface of the base;

multiple second sleeve mounts detachably connected with one of the sleeve tracks of the second bracket, each second sleeve mount having a base having a top surface and slidably connected with the corresponding one of the sleeve tracks of the second bracket, wherein the bases of the second sleeve mounts respectively have a round cross section and are slidably mounted in the groove of the first bracket; and a positioning button formed on and protruding from the top surface of the base of the second sleeve mount, wherein a cross section of the positioning button of each first sleeve mount is larger than that of each second sleeve mount; and multiple third sleeve mounts detachably connected with the other sleeve track of the second bracket, each third sleeve mount having a base having a top surface and slidably connected with the corresponding one of the sleeve tracks of the second bracket; and a positioning button formed on and protruding from the top surface of the base of the third sleeve mount, wherein a cross section of the positioning button of each second sleeve mount is larger than that of each third sleeve mount.

* * * * *